US005643616A

United States Patent [19]

Hess

[11] Patent Number: 5,643,616

[45] Date of Patent: Jul. 1, 1997

[54] CONCRETE-MOLDING MACHINE

[75] Inventor: Herbert Hess, Maselheim, Germany

[73] Assignee: Rampf Formen GmbH, Allmendingen, Germany

[21] Appl. No.: 519,165

[22] Filed: Aug. 25, 1995

[30] Foreign Application Priority Data

Aug. 27, 1994 [DE] Germany ..... 44 30 536.2

[51] Int. Cl.[6] ..... B28B 3/02; B30B 15/02

[52] U.S. Cl. ..... 425/195; 425/192 R

[58] Field of Search ..... 425/192 R, 193, 425/195, 451.9

[56] References Cited

U.S. PATENT DOCUMENTS

| | | | |
|---|---|---|---|
| 3,799,721 | 3/1974 | Howard | 425/195 |
| 4,116,599 | 9/1978 | Rüegg | 425/192 R |
| 4,484,880 | 11/1984 | Schwarz | 425/192 R |
| 4,773,839 | 9/1988 | Case et al. | 425/451.9 |
| 4,790,739 | 12/1988 | Manfredi | 425/195 |
| 5,078,586 | 1/1992 | Holzschuh | 425/195 |
| 5,259,742 | 11/1993 | Ichikawa et al. | 425/192 R |
| 5,486,101 | 1/1996 | Guyon | 425/195 |

FOREIGN PATENT DOCUMENTS

| | | |
|---|---|---|
| 0286553 | 10/1988 | European Pat. Off. . |
| 3025156 | 1/1982 | Germany . |
| 3613543 | 12/1986 | Germany . |
| 88152626 | 1/1989 | Germany . |
| 90042344 | 8/1990 | Germany . |
| 2252526 | 8/1992 | United Kingdom . |

OTHER PUBLICATIONS

2–page leaflet of Manfred Vetter GmbH, Zuelpich, Germany; date unknown.

*Primary Examiner*—James P. Mackey
*Attorney, Agent, or Firm*—Spencer & Frank

[57] ABSTRACT

Concrete-molding machine having a ram on which an upper mold part is fastened in a releasable manner. The quick-fastening device used for this purpose comprises connecting pins which have a shank and a widened cross-piece. In order to simplify the device, the connecting pins are fastened on the upper mold part by means of their shanks. Located on the ram or on a carrying plate fixedly connected thereto is a horizontal slide with keyhole-like clearances into which the connecting pins can be inserted from beneath. Pneumatic lifting elements grip below the slide and draw it up, in the connecting position, to the cross-pieces.

13 Claims, 5 Drawing Sheets

CONCRETE-MOLDING MACHINE

BACKGROUND OF THE INVENTION

The invention relates to a concrete-molding machine having a ram and having an upper mold part, which two parts can be clamped together in a vibration-resistant manner with the aid of pneumatic lifting elements.

A concrete-molding machine of this type is known from German Utility Model 88 15 262. According to the latter, the connecting members are configured as tie rods which hang down from the ram, have a wide head at the bottom and can be drawn upwards to the ram by means of individual pneumatic lifting elements. Formed in the abutment plate of the upper die part are a plurality of mutually parallel slots into which the shanks of the tie members can be inserted, In order to attach such an upper mold part, the latter is guided laterally in the horizontal direction into the tie rods, that is to say is suspended thereon, with the result that the bearing plate, and thus the entire upper mold part, bears with its weight on the heads of the tie rods. The pneumatic lifting elements then draw the upper mold part up to the ram, via the tie rods, until it rests firmly against the ram.

This known arrangement, also designated as a quick-change device, has two fundamental disadvantages. The long slots in the abutment plate of the upper mold part require a comparatively complicated substructure, which produces a free channel beneath the slots, through which channel the heads of the tie rods can be moved. On the other hand, the lateral extension and retraction of the upper mold part is unsatisfactory. This is usually carried out by the stacker truck, the accuracy of the movement control leaving something to be desired, which, on the other hand, has resulted in the tie rods being selected to be longer and larger, and the slots being selected to be wider, than they would have to be merely from strength aspects.

SUMMARY OF THE INVENTION

The object of the invention is to propose a concrete-molding machine in which use can be made of upper mold parts which are of a simpler design and, moreover, can be installed and dismantled in an uncomplicated manner.

This object is achieved by providing means for clamping the upper mold part to the movable ram in a vibration-resistant manner. The means includes at least one connecting member fastened to one of the movable ram and the upper mold part. The connecting member comprises a shank, and a widened head at one end of the shank. A horizontally arranged plate is attached to the other one of the movable ram and the upper mold part. The plate has at least one opening formed therein for receiving the shank of a respective connecting member. At least one horizontally arranged slide is guided on the plate. The slide has a clearance region with a widened portion and a narrowed portion, and is displaceable from a release position in which the widened head can pass through the widened portion of the clearance region, to a connecting position in which the shank passes through the narrowed portion and the widened head rests against the slide. At least one pneumatic lifting element is provided that comprises an inflatable cushion positioned to exert a clamping force against the slide. According to this, instead of the slots in the abutment plate, horizontal movable slides which have keyhole-like clearances are guided on one of the two parts which are to be connected. In contrast, the connecting members, which are configured preferably as pins with a mushroom-like flat head, are seated fixedly on the other part. They are, for example, screwed in. And finally, the pneumatic lifting elements act not on the connecting members, but on the slides.

In order to couple the two parts to one another, the connecting members are plugged, by means of their crops-pieces, in the vertical direction through the large opening in the keyhole configurations, and the slides are then actuated, for example by hand, with the result that the shanks of the connecting members are moved into the region of the narrow openings of the keyhole configurations and the cross-pieces rest against the slides. Consequently, the two parts are actually already connected to one another without a transverse movement of the upper mold part being necessary. The cross-pieces can no longer be freed from the slides. Therefore, when the lifting elements are then made to act between the slides and the part on which these are guided, the two parts are then brought to bear firmly against one another.

Elastic inflatable cushions, for example consisting of rubber, are suitable as pneumatic lifting elements. Particularly advantageous are so-called lifting cushions which have a flat rectangular form in the non-inflated state and consist of an extremely tear-resistant multiple-layer material, e.g. using aramida. These lifting cushions, which are known per se for a wide variety of application purposes, have the compressed-air connection on the border. For this reason too, they can be inserted into a gap of only a few centimeters. Since there is little risk of damaging the envelope, installation does not present any problems. Lifting forces of a number of tons can be produced by means of such cushions.

As a preferred embodiment of the invention, it is proposed that the connecting members be fastened on the upper mold part, with the slides and the pneumatic lifting elements being arranged on the molding machine. As a result, no other design measures are required on the upper mold parts, of which usually a large number is kept in stock. The upper parts may, as usual, be terminated by continuous abutment plates into which the connecting members are screwed.

The pneumatic lifting elements and the slides my be installed into the ram, which my have a multiple-layer rib or frame structure suitable for this purpose. Depending on the given conditions in the case of the relevant concrete-molding machine, however, it is not unknown for a distance of approximately 30 to 50 cm between the ram and the upper mold part to be spanned, a so-called intermediate lead of corresponding height then being installed between these two parts. Such an intermediate load is particularly suitable for receiving the slide and the pneumatic lifting elements. It can, then, be installed namely on the carrying plate which forms the underside of the intermediate lead. The carrying plate has to have correspondingly arranged and sufficiently large through-passage apetings for the cross-pieces of the connecting elements.

If use is made, of an active element, comprised of a rubber cushion which has its line connection on the flat side, then it is proposed that the said cushion be fitted on a base plate spaced apart from the carrying plate via feet and presses on the upper part of a clamping frame. The lower part of the clamping frame passes beneath the base plate, with the slide being arranged between the lower part and the base plate. According to a preferred embodiment, the clamping frame comprises an upper plate and a lower plate, which are connected to one another by two mutually opposite vertical connecting plates, the lower plate having a through-passage opening for the cross-piece of the respective connecting member. The slide can be guided between the feet. There must be such a distance between the slide and the base plate, when the active element is in the relieved state, that the cross-piece has enough space and can also be moved upwards until the upper mold part comes to rest against the ram.

In order to counteract the risk that the slide could move back under the vibration loading which occurs and the connecting members could loosen, it is proposed that interengaging elevations and depressions, for example a projecting protuberance on one side and an indent on the other side, be provided on the contact surfaces of the slide and its guide. The shaped portions enter into one another when the slide is in the locked connecting position and, when the lifting elements are in the clamped state, reliably prevent any possible slow longitudinal movement of the slide. On the other hand, however, locking by means of catches is also possible.

The use of lifting cushions renders dispensable an individual design for the pneumatic lifting elements. In principle, all that is needed is for in each case one lifting cushion to be inserted between the slides and their carrying plate. For better distribution of the lifting forces, it is proposed to arrange a common supporting plate beneath the slides and to insert the lifting cushions between the carrying plate and the supporting plate. On that side of the supporting plate which is oriented towards the carrying plate there may be arranged strips which enclose the lifting cushion, prevent a horizontal movement of the same and, moreover, maintain a specific minimum distance between the supporting plate and the carrying plate.

BRIEF DESCRIPTION OF THE DRAWINGS

Exemplary embodiments of the invention are explained hereineblow with reference to the drawing, in which, in detail.

DETAILED DESCRIPTION OF THE INVENTION

Figures 1, 4:
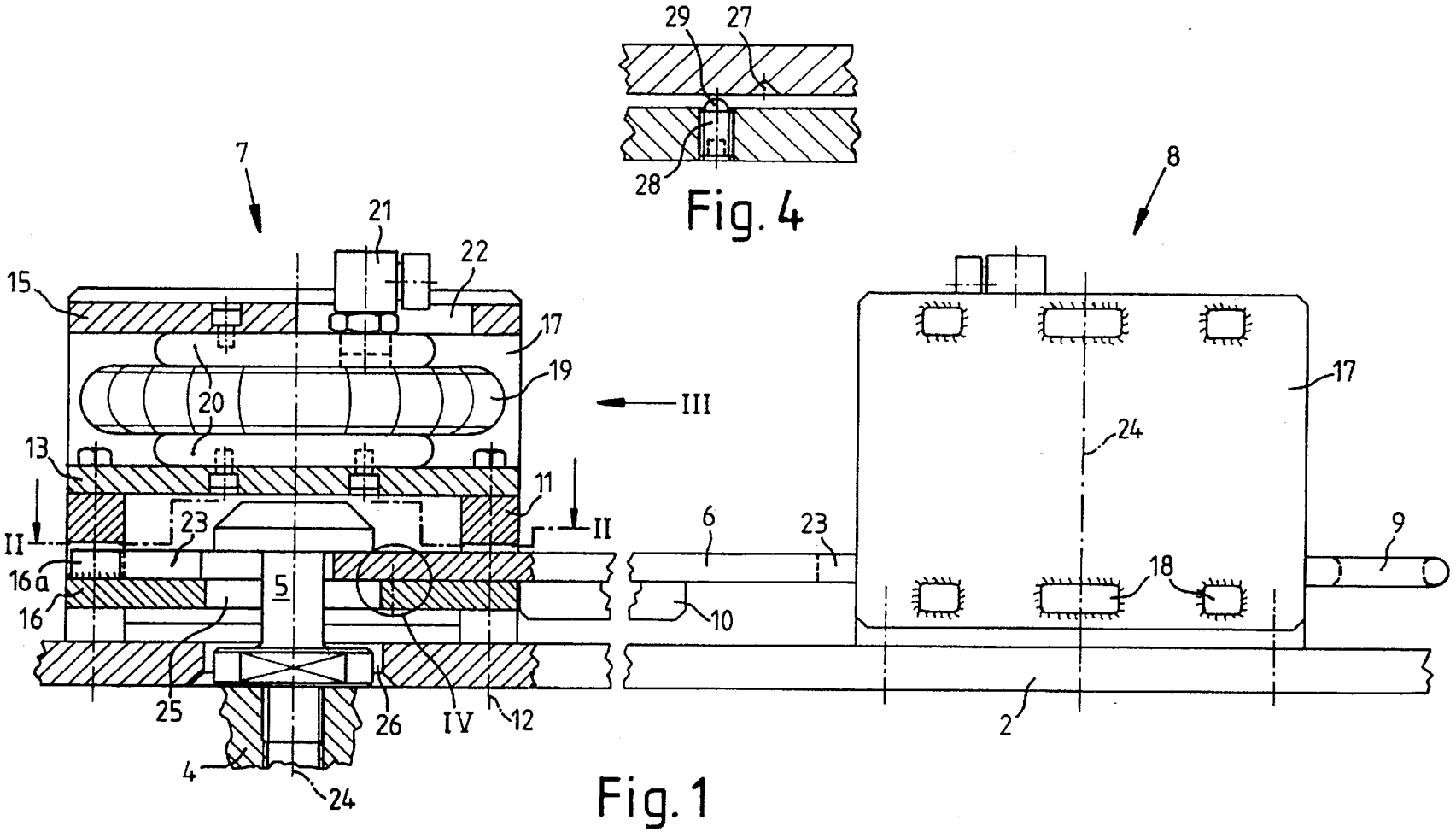
FIG. 1 shows the side view of a quick-clamping module for the upper die part of the concrete-molding machine, the left-hand lifting element being represented in longitudinal section.
FIG. 4 shows the detail IV from FIG. 1 on an enlarged scale and with the slide in a different position.
Figure 2:
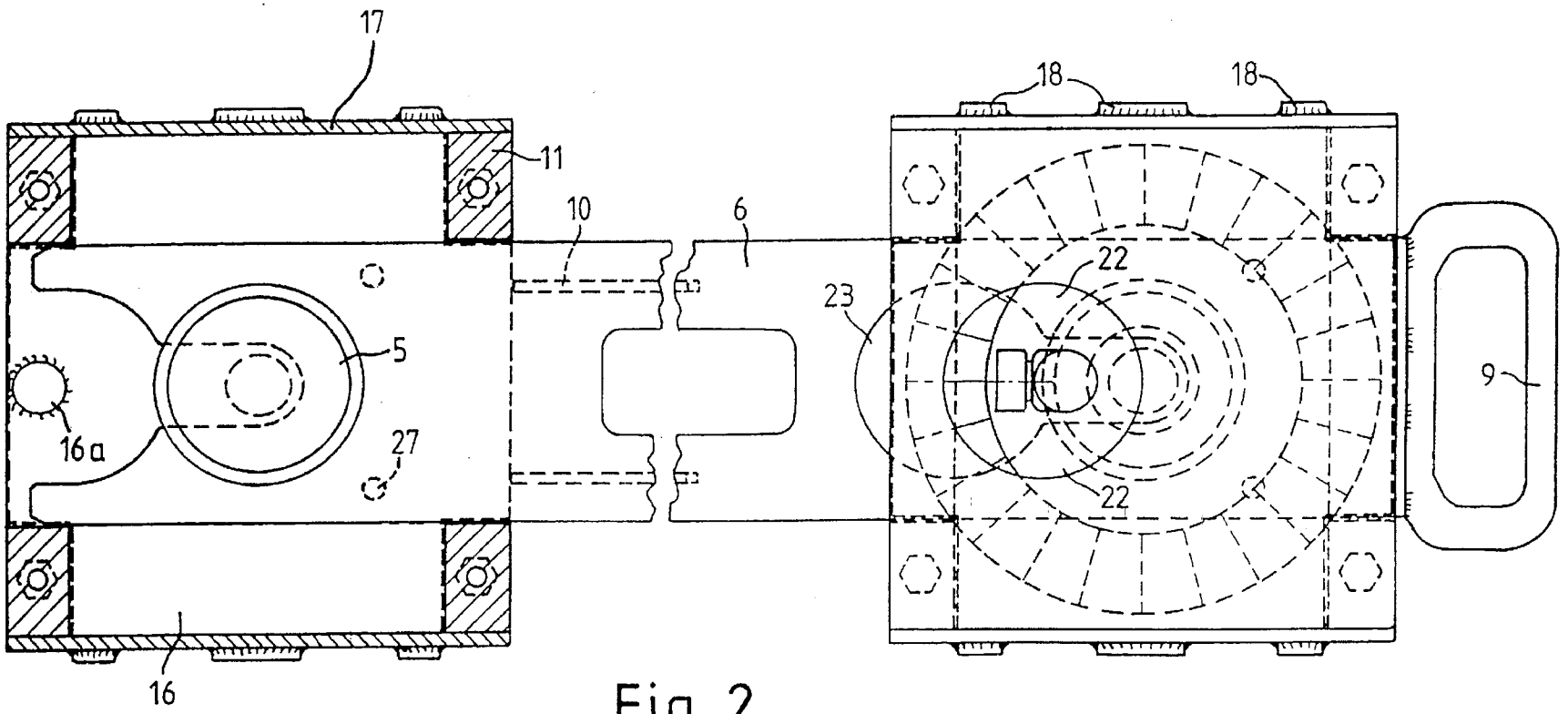
FIG. 2 shows the plan view of the quick-clamping module according to FIG. 1, the left-hand lifting element being cut away horizontally along section line II—II.
Figure 6:
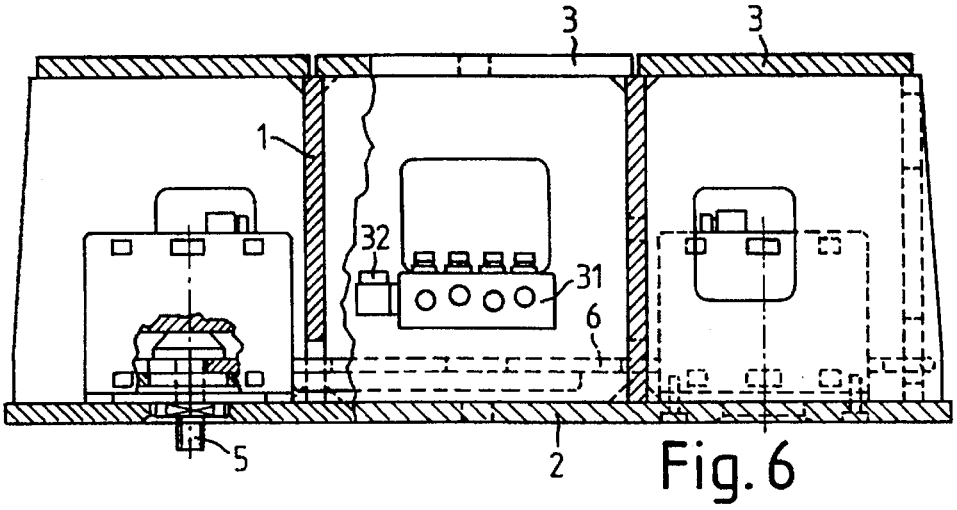
FIG. 6 shows a vertical section VI—VI of the intermediate load according to FIG. 5.
Figure 5:
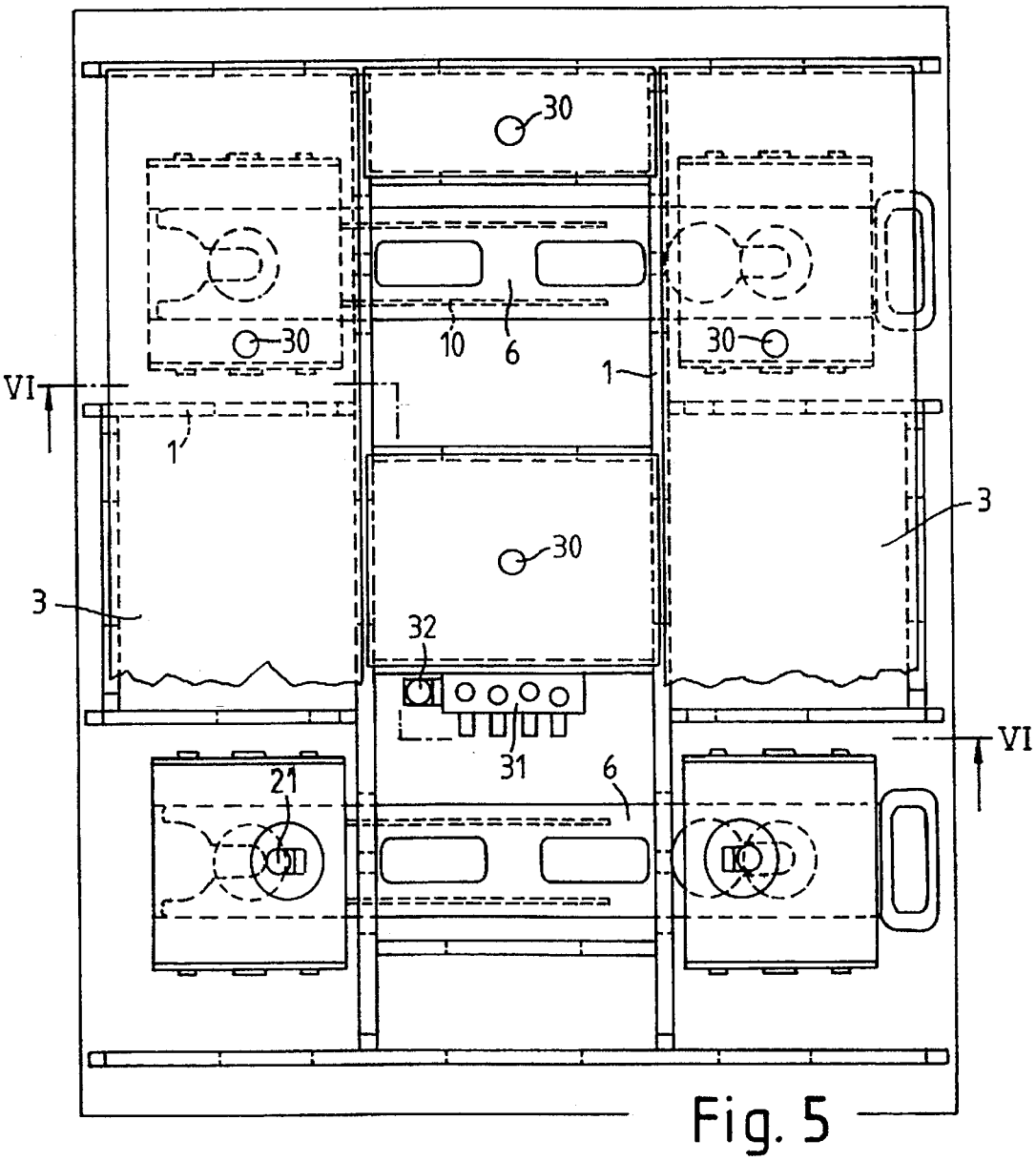
FIG. 5 shows, on a smaller scale, a plan view, partially cut away, of an intermediate load containing two quick-clamping modules according to FIG. 1.

The intermediate load according to FIGS. 5 and 6 is a box structure having a plurality of rib walls 1, a horizontal carrying plate 2 as base and a plurality of smaller horizontal screw-on plates 3 as upper covering. The intermediate load, which has a height of approximately 350 mm, is screwed onto the ram of a concrete-molding machine from beneath. An upper mold part is fitted onto its carrying plate 2 with the aid of two quick-clamping modules which will be described below, that is to say the upper mold part is connected fixedly to the intermediate load such that it rests directly against the latter. The upper mold part 4 is only indicated in FIG. 1 in fragmentary form on the connecting pin 5 shown there.

By means of a concrete-molding machine, with the aid of various molds, an extremely wide range of concrete moldings, for example paving setts of various configurations and dimensions, can be produced. For this purpose, the molds have to be changed quickly, often a number of times a day.

The quick-clamping module according to FIG. 1 to 4 is fitted directly onto the carrying plate 2 of the intermediate load. It comprises a slide 6 and two approximately cube-shaped lifting elements 7 and 8. The slide 6 is a flat iron member with a handle 9 at the right-hand end, which slide 6 is fitted parallel to the carrying plate 2 and passes through the two lifting elements 7 and 8. It is guided in the lifting elements and is restricted in its displacement by two stop stripe 10 fitted on its underside. The stop strips 10 come to rest against the lifting elements in the end positions.

Figure 3:
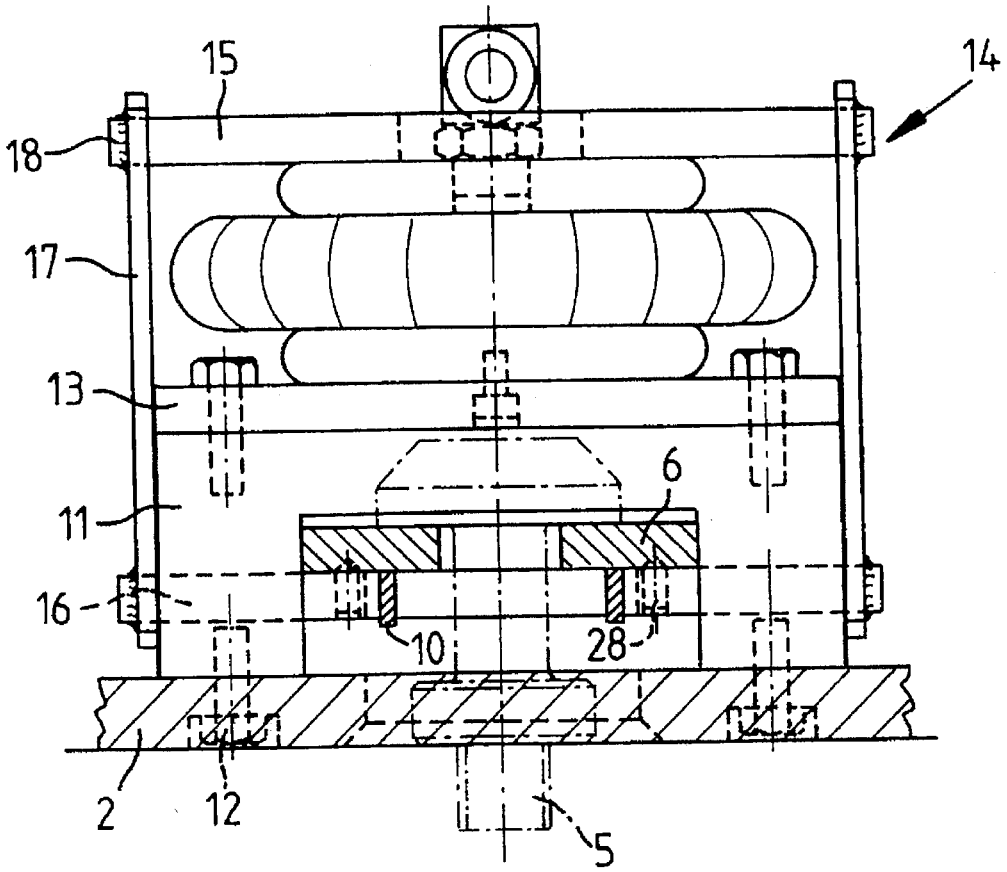
FIG. 3 shows a view of the lifting elements from the right in the direction of the arrow III, the slides and the lower plate of the clamping frame being shown in cross-section in the axial plane of the connecting pin.

The lifting elements 7 and 8 do not differ in any way, so that it is sufficient to describe only one of them. As FIG. 3 best shows, two mutually parallel U-shaped foot brackets 11 (supporting elements) are provided, which foot brackets 11 stand on the carrying plate 2 by means of their leg ends and are screwed to the carrying plate 2 by means of screws 12. An approximately square base plate 13 is screwed on the foot 11. FIG. 3 also shows that the slide 6 is guided laterally on the inner leg edges of the foot brackets 11 and has a degree of clearance at the top towards the web of the foot bracket.

As force-transmission member, the lifting element 7 or 8 has a clamping frame 14, which comprises an upper plate 15, a lower plate 16 and two mutually opposite vertical connecting plates 17. Formed on in each case two opposite borders of the plates 15 and 16 are in each case three pin-like protrusions 18 which pass through corresponding clearances in the connecting plates 17. Moreover, the plates are welded to one another in the region of these joints, with the result that the rectangular clamping frame 14 has a considerable loading capacity. It is arranged such that the lower plate 16 passes beneath the slide 6 and the connecting plates 17 rest, with a very small spacing, against the borders of the base plate 13, with the result that the clamping frame cannot be laterally displaced (FIG. 3). Moreover, the lower plate 16 is arranged such that, as is shown on the left-hand side in FIG. 2, it is cut away precisely around the legs of the foot bracket (11). It can thus be moved up and down, but cannot rotate or he displaced in terms of plane.

The active member of the lifting element 7 or 8 is a flat round expansion chamber 19 which consists of rubber is fixedly connected to two connecting plates 20. The lower connecting plate is fixedly screwed to the base plate 13 and the upper connecting plate is fixedly screwed to the upper plate 15 of the clamping frame. A screw-connection 21 for compressed air is screwed into the upper connecting plate 20 and projects upwards through a round opening 22 in the upper plate 15. If the expansion chamber 19 is provided with compressed air, then its height is increased with simultaneous reduction of the diameter. Consequently, the clamping frame 14 is forced upwards, the lower plate 16 of the clamping frame raising the slide 6.

In order to connect the upper mold part 4 to the intermediate load, four connecting pins 5 are fixedly screwed into the connecting plate, which terminates the upper mold part towards the top. Each lifting element is assigned such a connecting pin 5. Above its threaded shank, the individual connecting pin has a disc-like collar with two surfaces for the attachment of a screwdriver, there then follows a cylindrical pin neck and this is terminated at the top by a flat round head which is beveled obliquely at the top. The head and the collar are approximately the same diameter. A system of matching openings in the carrying plate 2 of the intermediate load, in the lower plate 16 of the clamping frame and in the slide 6 makes it possible for the respective connecting pin 5 to be inserted, locked and clamped in the associated lifting element 7 or 8. The slide 6 has two keyhole-like openings 23 which are assigned to the two lifting elements 7 and 8. The larger circular part of the keyhole-ilks openings 23 has a diameter of such a size that the head of the connecting pin 5 passes through it with good effect. In the longitudinal direction of the slide, the round part is adjoined by a narrower, slot-like part of the opening 23, the width of which corresponds to the diameter of the pin neck and which terminates in a rounded portion.

However, the keyhole-like opening 23 is not quite complete at the left-hand end of the slide 6; rather, the slide end is forked. At this location, a flat-cylindrical spacer 16*a* is fastened on the plate 16, which spacer, in the event of unintentional operation of the expansion chamber 19, is supported on the foot bracket 11 with the slide 6 in the open state.

In all the representations, the slide 6 is located in its left-hand, locking position. In this position, the stop scrips 10 rest against the lower plate 16 of the clamping frame of the lifting element 7. If the slide is pulled by the handle 9 towards the right until the stop strips 10 come to rest against the lower plate of the clamping frame of the lifting element 8, the slide is located in its open position. In this position, the centre points of the large opening parts of the keyhole-like openings 23 are located in the axes 24 of the connecting pins 5. Circular openings 25 and 26 in the lower plate 16 and in the carrying plate 2, respectively, are located coaxially therebeneath. These openings 25 and 26 are approximately the same diameter as the large parts of the keyhole-like openings 23 in the slide. Their diameter is approximately 10% greater than the diameter of the head of the connecting pin 5.

It is thus evident that, by vertical lowering of the intermediate load during slow operation of the concrete-molding machine, the connecting pins 5 can, when the slide 6 is in the open state, be introduced into the lifting elements 7 and 8, into the position shown in FIGS. 1 and 3. The head of the connecting pin first of all passes through the opening 26 of the carrying plate 2 and then through the opening 25 in the lower plate 16 of the clamping frame and, finally, through the large part of the keyhole-like opening 23 of the slide 6. The slide can then be displaced into its locking position, the connecting-pin shank passing into the slot-like part of the keyhole-like opening 23 and the connecting-pin head bearing on the slide 6 with the largest part of its circumference. If the expansion chambers 19 are then subjected to pressure, the clamping forces act on the connecting pins 5 via the slide 6, with the result that the upper mold part can be drawn, with full force, up to the intermediate load and the slide 6 can no longer be moved, due to the surface-area pressing action which has been effected.

In order reliably to prevent a vibrating return of the slide, the latter has, on the underside, a plurality of indents 27 (FIG. 4) which interact with headless pins 28. The headless pins are screwed into continuous thread bores in the lower plates 16 and project, by means of their upper end in the form of a protuberance 29, beyond the surface of the plate. The arrangement is such that, in the locking position of the slide 6, the protuberances 29 are received by the indents 27 located thereabove. When the slide is opened, the protuberances slide out of the indents, and the slide is raised slightly and slides on the tops of the protuberances (FIG. 4).

FIGS. 5 and 6 give an idea of the installation of the two quick-clamping modules into the intermediate load. On the rectangular carrying plate 2, four rib walls 1 run in the longitudinal direction, namely two long rib walls in the centre and two short rib walls along the right-hand and left-hand borders. At the narrow ends, two rib walls run in the transverse direction over the entire width, while four shorter rib walls subdivide the central area in the transverse direction and in each case two shorter rib walls 1 connect the shorter longitudinal walls in the transverse direction to the longer central longitudinal walls. Consequently, five areas are formed in the longitudinal centre, of which the central area and the two small areas at the ends are covered by screw-on plates 3, while two longer continuous screw-on plates 3 extend over the lateral areas. The screw-on plates 3 are welded to the rib walls 1 and have fastening bores 30 for screwing the intermediate load onto the ram.

The long screw-on plates 3 in FIG. 5 are each represented in a partially broken-away state, with the result that the entire quick-clamping module can be seen freely in the lower part of the figure. In particular, the slide 6 is represented in its full length here. It passes through the central longitudinal rib walls 1 which have been provided with corresponding clearances. In order to cut down on the weight, rectangular clearances are provided in the rib walls 1 and also in the slide 6. A compressed-air distributor 31 has a screw-connection 32 for a common compressed-air connection and four outgoing connections which are connected, via hose lines (not shown), to the screw-connections 21 of the four expansion chambers 19.

Figure 8:
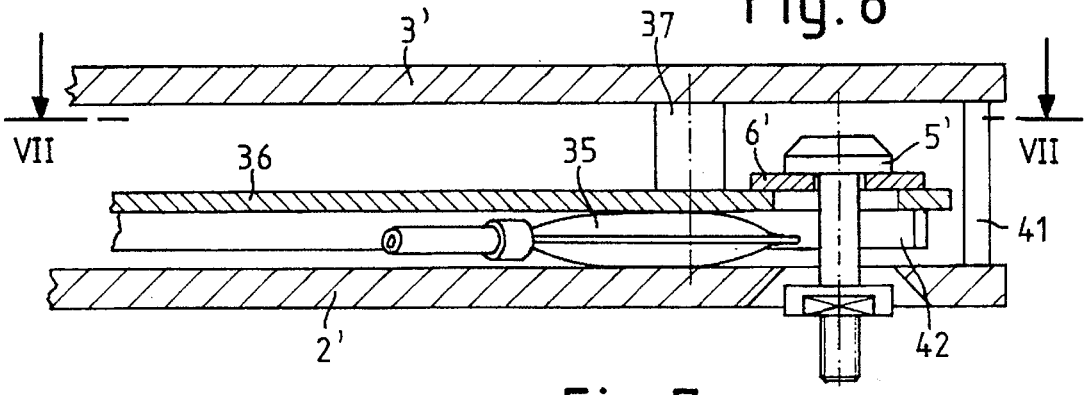
FIG. 8 shows a vertical section VIII—VIII of the intermediate load according to FIG. 7.
Figure 7:
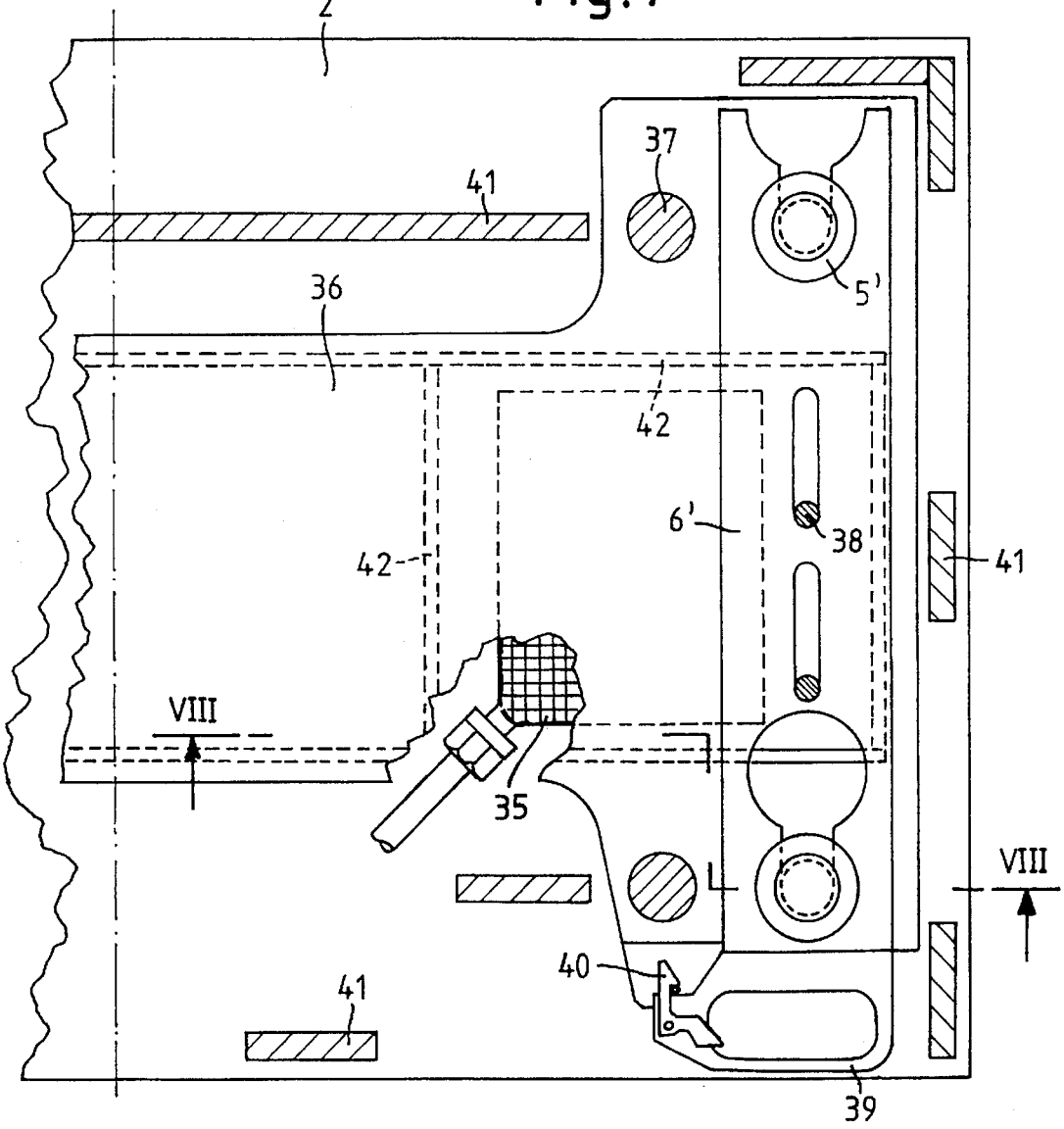
FIG. 7 shows a horizontal section VII—VII of the broken-away half of a different intermediate load.

The second example, represented in FIGS. 7 and 8, is of a considerably simpler design due to the use of so-called lifting cushions 35. These are a modern aid which are used by the rescue services and fitters not only for lifting, but also for pressing, splitting and caulking, and which produces forces of a number of tons. These cushions are in a flat rectangular form in the non-inflated state. The compressed-air connection is located on the border, preferably at a comer. The cushion material is extremely tear-resistant and has a multiple-layer design of plastic with fabric inserts, in particular a netting consisting of aramide.

The chain-dotted centre line in FIG. 7 shows that the broken-away part of the intermediate load is of a mirror-inverted form. Altogether, two lifting cushions 35 and two slides 6' are thus present. The two slides 6' bear on a common supporting plate 36 of H-shaped outline. The latter is vertically freely movable and guided on spacer bolts 37 which pass through it and connect the carrying plate 2' to its screw-on plate 3'. The slides 6' are essentially the same form as in the case of the first example, but, here, are guided in the sliding direction by two guide pine 38 which move in longitudinal slots. Each slide has a handle 39 at the front and is arrested in the connecting position shown by a catch 40 arranged on the handle. The catch can be released by the thumb when the slides are drawn out. The carrying plate 2' is connected to the screw-on plate 3' not only by the spacer bolt 37, but also by various vertical wall sections 41.

The lifting cushions 35 are inserted between the carrying plate 2' and the supporting plate 36 and are enclosed by strips 42. The strips are fitted on the underside of the supporting plate 36 and bring about a specific minimum distance between the supporting plate 36 and the carrying plate 2', with the result that the lifting cushion is not subjected to any pressure loading in the non-inflated state. Moreover, the strips 42 prevent horizontal displacement of the lifting cushion.

The function of the quick-clamping device according to this example corresponds to that of the first example. It is assumed that an upper mold part is to be attached to the intermediate load, which is fastened on the underside of a ram of a machine for molding concrete blocks. For this purpose, the upper mold part is made ready and the slides 6' are in the drawn-back state. The ram moves slowly downwards with the intermediate load. In this arrangement, the connecting pins 5' of the upper mold part pass from beneath into the keyhole-like openings of the slides, with the result that, finally, the heads of the connecting pins 5' are located above the slides 6'. In the meantime, the supporting plate 36 bears on the carrying plate 2' by means of its strips 42. The slides are then pushed in and locked by means of their catches 40. The lifting cushions 35 are then subjected to pressure, with the result that the supporting plate 36 rises and, via the slides 6', carries along the connecting pins 5' of the upper mold part end thus brings the latter to rest firmly against the intermediate load. In order to demount the upper mold part, this sequence expediently takes place in reverse order.

I claim:

1. A concrete-molding machine having a movable ram, and an upper mold part positionable below the movable ram, and comprising:

means for clamping the upper mold part to the movable ram in a vibration-resistant manner, said means including:

at least one connecting member fastened to one of the movable ram and the upper mold part, said connecting member comprising a shank, and a widened head at one end of said shank;

a horizontally arranged plate attached to the other one of the movable ram and the upper mold part, said plate having at least one opening formed therein for receiving the shank of a respective connecting member;

at least one horizontally arranged slide guided on the plate, said slide having a clearance region with a widened portion and a narrowed portion, and being displaceable from a release position in which the widened head can pass through the widened portion of the clearance region, to a connecting position in which the shank passes through the narrowed portion and the widened head rests against said slide; and at least one pneumatic lifting element comprising an inflatable cushion positioned to exert a clamping force against said slide.

2. The concrete-molding machine defined in claim 1, wherein said inflatable cushion comprises a lifting cushion having a non-inflated condition in which said cushion has an essentially flat, rectangular shape, said lifting cushion being comprised of a tear-resistant multiple-layer material, and having a connection device positioned on a border thereof for connection with a flexible pressure line.

3. The concrete-molding machine defined in claim 1, wherein said connecting member is fastened to the upper mold part, said horizontally arranged plate comprising a carrying plate attached to an underside of the movable ram and having through-passage openings sized to allow the widened head of said connecting member to pass therethrough, said pneumatic lifting element and said slide being arranged on said carrying plate.

4. The concrete-molding machine defined in claim 3, wherein said pneumatic lifting element further comprises:

a plurality of supporting elements positioned on said carrying plate, a base plate resting on said supporting elements, and a clamping frame having an upper part positioned above said base plate, and a lower part passing below said base plate, said slide being positioned between said base plate and said lower part, said inflatable cushion being fitted on said base plate.

5. The concrete-molding machine defined in claim 4, wherein said upper part of said clamping frame comprises an upper plate, and said lower part of said clamping frame comprises a lower plate having a through passage opening sized to allow the widened head of said connecting member to pass therethrough, said clamping frame further comprising two mutually opposite, vertically arranged connecting plates connecting said upper plate to said lower plate.

6. The concrete-molding machine defined in claim 5, wherein said slide and said lower plate each have mutually contacting surfaces having inter-engaging elevations and depressions located thereon.

7. The concrete-molding machine defined in claim 3, wherein said inflatable cushion comprises a lifting cushion inserted between said slide and said carrying plate.

8. The concrete-molding machine defined in claim 7, wherein said pneumatic lifting element further comprises a common supporting plate loosely arranged between said lifting cushion and said slide.

9. A concrete-molding machine having a movable ram, and an upper mold part positionable below the movable ram, and comprising:

means for clamping the upper mold part to the movable ram in a vibration-resistant manner, said means including:

at least one connecting member fastened to the upper mold part, said connecting member comprising a shank, and a widened cross-piece at one end of said shank;

a horizontally arranged carrying plate attached to an underside of the movable ram, said plate having at least one through-passage opening sized to allow the widened piece of said connecting member to pass therethrough so as to receive the shank thereof;

at least one horizontally arranged slide arranged and guided on said plate, said slide having a clearance region with a widened portion and a narrowed portion, and being displaceable from a release position in which the widened cross-piece can pass through the widened portion of the clearance region, to a connecting position in which the shank passes through the narrowed portion and the widened cross-piece rests against said slide; and at least one pneumatic lifting element located on said carrying plate and being positioned to exert a clamping force against said slide, said pneumatic lifting element comprising:

a plurality of supporting elements positioned on said carrying plate, a base plate resting on said supporting elements, a clamping frame having an upper part positioned above said base plate, and a lower part passing below said base plate, said slide being positioned between said base plate and said lower part, and an inflatable cushion fitted on said base plate.

10. The concrete-molding machine defined in claim 9, wherein said upper part of said clamping frame comprises an upper plate, and said lower part of said clamping frame comprises a lower plate having a through passage opening sized to allow the widened cross-piece of said connecting member to pass therethrough, said clamping frame further comprising two mutually opposite, vertically arranged connecting plates connecting said upper plate to said lower plate.

11. The concrete-molding machine defined in claim 10, wherein said slide and said lower plate each have mutually contacting surfaces having inter-engaging elevations and depressions located thereon.

12. A concrete-molding machine having a movable ram, and an upper mold part positionable below the movable ram, and comprising:

means for clamping the upper mold part to the movable ram in a vibration-resistant manner, said means including:

at least one connecting member fastened to the upper mold part, said connecting member comprising a shank, and a widened cross-piece at one end of said shank;

a horizontally arranged carrying plate attached to an underside of the movable ram, said plate having at least one through-passage opening sized to allow the widened piece of said connecting member to pass therethrough so as to receive the shank thereof;

at least one horizontally arranged slide arranged and guided on said plate, said slide having a clearance region with a widened portion and a narrowed portion, and being displaceable from a release position in which the widened cross-piece can pass through the widened portion of the clearance region, to a connecting position in which the shank passes through the narrowed portion and the widened cross-piece rests against said slide; and at least one pneumatic lifting element located on said carrying plate and being positioned to exert a clamping force against said slide, said lifting element comprising a lifting cushion inserted between said slide and said carrying plate.

13. The concrete-molding machine defined in claim 12, wherein said pneumatic lifting element further comprises a common supporting plate loosely arranged between said lifting cushion and said slide.

* * * * *